US008636285B2

(12) United States Patent
Grauzer et al.

(10) Patent No.: US 8,636,285 B2
(45) Date of Patent: Jan. 28, 2014

(54) ERGONOMIC CARD DELIVERY SHOE

(75) Inventors: Attila Grauzer, Las Vegas, NV (US); Paul K. Scheper, Bloomington, MN (US); Sion D. Walsh, Las Vegas, NV (US)

(73) Assignee: SHFL Entertainment, Inc., Las Vegas, NV (US)

( * ) Notice: Subject to any disclaimer, the term of this patent is extended or adjusted under 35 U.S.C. 154(b) by 198 days.

(21) Appl. No.: 12/501,322

(22) Filed: Jul. 10, 2009

(65) Prior Publication Data

US 2010/0013152 A1 Jan. 21, 2010

Related U.S. Application Data

(63) Continuation-in-part of application No. 11/983,463, filed on Nov. 9, 2007, now abandoned, and a continuation-in-part of application No. 11/417,894, filed on May 3, 2006, now Pat. No. 7,593,544.

(51) Int. Cl.
*A63F 1/14* (2006.01)
*A63F 1/12* (2006.01)

(52) U.S. Cl.
USPC ..... 273/149 R; 273/148 R; 273/149 P; 273/148 A; D21/392; D21/393

(58) Field of Classification Search
CPC ..... A63F 1/12; A63F 1/14
USPC ..... 273/149 R, 149 P, 309, 148 R, 148 A; D21/396, 392–393
IPC ..... A63F 1/12, 1/14
See application file for complete search history.

(56) References Cited

U.S. PATENT DOCUMENTS 449,316 A * 3/1891 Falkingham ..... 273/149 R
609,729 A * 8/1898 Booth ..... 273/149 R
609,730 A * 8/1898 Booth ..... 273/149 R (Continued)

FOREIGN PATENT DOCUMENTS

CA 2612138 A1 12/2006
DE 44 39 502 6/1995

(Continued)

OTHER PUBLICATIONS

Genevieve Orr, CS-449: Neural Networks, Willamette University; http://willamette.edu/-gorr/classes/cs449/intro.html; Fall 99, printed Nov. 13, 2008.

(Continued)

*Primary Examiner* — Alvin Hunter
*Assistant Examiner* — Matthew B Stanczak
(74) *Attorney, Agent, or Firm* — TraskBritt

(57) ABSTRACT

An apparatus for handling cards has a dispensing end. The dispensing end has a base plate for supporting cards being manually removed. An upper plate with a U-shaped opening is spaced above the base plate and defines a slot for cards to pass. First and second spaced apart card guides define side edges of the slot. The first card guide is shorter than the second card guide, creating an offset in a first direction of travel of cards being removed. A method of removing cards is also disclosed, enabling movement of cards in at least two directions due to the presence of a card guide offset.

14 Claims, 8 Drawing Sheets

(56) References Cited

U.S. PATENT DOCUMENTS

| | | | | |
|---|---|---|---|---|
| 1,831,580 | A | 11/1931 | Stecker | |
| 1,931,233 | A * | 10/1933 | Marsh | 273/309 |
| 2,201,187 | A * | 5/1940 | Levin | 273/148 A |
| D132,360 | S * | 5/1942 | Gardner | D21/392 |
| 2,395,138 | A | 2/1946 | Nichols | |
| 2,432,248 | A * | 12/1947 | Milone | 273/292 |
| 3,222,071 | A | 12/1965 | Lang | |
| 3,929,339 | A | 12/1975 | Mattioli | |
| 4,377,285 | A * | 3/1983 | Kadlic | 273/148 A |
| D274,069 | S * | 5/1984 | Fromm | D21/392 |
| 4,494,197 | A | 1/1985 | Troy et al. | |
| 4,659,082 | A * | 4/1987 | Greenberg | 273/149 R |
| 4,667,959 | A | 5/1987 | Pfeiffer et al. | |
| 4,750,743 | A | 6/1988 | Nicoletti | |
| 4,926,327 | A | 5/1990 | Sidley | |
| 4,995,615 | A | 2/1991 | Cheng | |
| 5,000,453 | A * | 3/1991 | Stevens et al. | 273/149 R |
| 5,078,405 | A | 1/1992 | Jones et al. | |
| 5,179,517 | A | 1/1993 | Sarbin et al. | |
| 5,199,710 | A | 4/1993 | Lamle | |
| 5,209,476 | A | 5/1993 | Eiba | |
| 5,224,712 | A | 7/1993 | Laughlin et al. | |
| 5,257,179 | A | 10/1993 | DeMar | |
| 5,276,312 | A | 1/1994 | McCarthy | |
| 5,283,422 | A | 2/1994 | Storch et al. | |
| 5,356,145 | A | 10/1994 | Verschoor | |
| 5,362,053 | A | 11/1994 | Miller | |
| 5,364,104 | A | 11/1994 | Jones et al. | |
| 5,374,061 | A * | 12/1994 | Albrecht | 273/149 R |
| 5,382,024 | A * | 1/1995 | Blaha | 273/149 R |
| 5,393,067 | A | 2/1995 | Paulsen et al. | |
| 5,431,399 | A | 7/1995 | Kelley | |
| 5,470,079 | A | 11/1995 | LeStrange et al. | |
| 5,544,893 | A | 8/1996 | Jones et al. | |
| 5,586,766 | A | 12/1996 | Forte et al. | |
| 5,586,936 | A | 12/1996 | Bennett et al. | |
| 5,605,334 | A | 2/1997 | McCrea, Jr. | |
| 5,613,912 | A | 3/1997 | Slater | |
| 5,655,961 | A | 8/1997 | Acres et al. | |
| 5,669,816 | A | 9/1997 | Garczynski et al. | |
| 5,681,039 | A | 10/1997 | Miller | |
| 5,722,893 | A | 3/1998 | Hill et al. | |
| 5,735,525 | A | 4/1998 | McCrea, Jr. | |
| 5,770,533 | A | 6/1998 | Franchi | |
| 5,772,505 | A | 6/1998 | Garczynski et al. | |
| 5,779,546 | A | 7/1998 | Meissner et al. | |
| 5,781,647 | A | 7/1998 | Fishbine et al. | |
| 5,788,574 | A | 8/1998 | Ornstein et al. | |
| 5,803,808 | A | 9/1998 | Strisower | |
| 5,911,626 | A | 6/1999 | McCrea, Jr. | |
| 5,919,090 | A | 7/1999 | Mothwurf | |
| 5,932,139 | A | 8/1999 | Oshima et al. | |
| 5,941,769 | A | 8/1999 | Order | |
| 5,989,122 | A | 11/1999 | Roblejo | |
| 6,039,650 | A | 3/2000 | Hill | |
| 6,071,190 | A | 6/2000 | Weiss et al. | |
| 6,093,103 | A | 7/2000 | McCrea, Jr. | |
| 6,117,012 | A | 9/2000 | McCrea, Jr. | |
| D432,588 | S * | 10/2000 | Tedham | D21/396 |
| 6,126,166 | A | 10/2000 | Lorson et al. | |
| 6,165,069 | A | 12/2000 | Sines et al. | |
| 6,217,447 | B1 | 4/2001 | Lofink et al. | |
| 6,250,632 | B1 | 6/2001 | Albrecht | |
| 6,254,096 | B1 | 7/2001 | Grauzer et al. | |
| 6,267,248 | B1 | 7/2001 | Johnson et al. | |
| 6,267,671 | B1 | 7/2001 | Hogan | |
| 6,270,404 | B2 | 8/2001 | Sines et al. | |
| 6,293,864 | B1 | 9/2001 | Romero | |
| 6,299,536 | B1 | 10/2001 | Hill | |
| 6,313,871 | B1 | 11/2001 | Schubert | |
| 6,346,044 | B1 | 2/2002 | McCrea, Jr. | |
| 6,361,044 | B1 | 3/2002 | Block et al. | |
| 6,403,908 | B2 | 6/2002 | Stardust et al. | |
| 6,446,864 | B1 | 9/2002 | Kim et al. | |
| 6,460,848 | B1 | 10/2002 | Soltys et al. | |
| 6,517,435 | B2 | 2/2003 | Soltys et al. | |
| 6,517,436 | B2 | 2/2003 | Soltys et al. | |
| 6,520,857 | B2 | 2/2003 | Soltys et al. | |
| 6,527,271 | B2 | 3/2003 | Soltys et al. | |
| 6,530,836 | B2 | 3/2003 | Soltys et al. | |
| 6,530,837 | B2 | 3/2003 | Soltys et al. | |
| 6,532,297 | B1 | 3/2003 | Lindquist | |
| 6,533,276 | B2 | 3/2003 | Soltys et al. | |
| 6,533,662 | B2 | 3/2003 | Soltys et al. | |
| 6,579,180 | B2 | 6/2003 | Soltys et al. | |
| 6,579,181 | B2 | 6/2003 | Soltys et al. | |
| 6,582,301 | B2 | 6/2003 | Hill | |
| 6,582,302 | B2 | 6/2003 | Romero | |
| 6,585,586 | B1 | 7/2003 | Romero | |
| 6,595,857 | B2 | 7/2003 | Soltys et al. | |
| 6,616,535 | B1 | 9/2003 | Nishizaki et al. | |
| 6,622,185 | B1 | 9/2003 | Johnson et al. | |
| 6,629,889 | B2 | 10/2003 | Mothwurf | |
| 6,629,894 | B1 | 10/2003 | Purton | |
| 6,637,622 | B1 * | 10/2003 | Robinson | 221/268 |
| 6,638,161 | B2 | 10/2003 | Soltys et al. | |
| 6,645,068 | B1 | 11/2003 | Kelly et al. | |
| 6,645,077 | B2 | 11/2003 | Rowe | |
| 6,652,379 | B2 | 11/2003 | Soltys et al. | |
| 6,663,490 | B2 | 12/2003 | Soltys et al. | |
| 6,666,768 | B1 | 12/2003 | Akers | |
| 6,685,567 | B2 | 2/2004 | Cockerille et al. | |
| 6,685,568 | B2 | 2/2004 | Soltys et al. | |
| 6,688,979 | B2 | 2/2004 | Soltys et al. | |
| 6,698,756 | B1 | 3/2004 | Baker et al. | |
| 6,712,696 | B2 | 3/2004 | Soltys et al. | |
| 6,719,634 | B2 | 4/2004 | Mishina et al. | |
| 6,746,333 | B1 | 6/2004 | Onda et al. | |
| 6,758,751 | B2 | 7/2004 | Soltys et al. | |
| 6,758,757 | B2 | 7/2004 | Luciano, Jr. et al. | |
| 6,804,763 | B1 | 10/2004 | Stockdale et al. | |
| 7,231,812 | B1 | 6/2007 | Lagare | |
| 7,261,294 | B2 | 8/2007 | Grauzer et al. | |
| 7,264,241 | B2 | 9/2007 | Schubert et al. | |
| 7,322,576 | B2 | 1/2008 | Grauzer et al. | |
| 7,407,438 | B2 | 8/2008 | Schubert et al. | |
| 7,946,586 | B2 * | 5/2011 | Krenn et al. | 273/149 R |
| 2001/0036231 | A1 | 11/2001 | Easwar et al. | |
| 2001/0036866 | A1 | 11/2001 | Stockdale et al. | |
| 2002/0107067 | A1 | 8/2002 | McGlone et al. | |
| 2002/0187830 | A1 | 12/2002 | Stockdale et al. | |
| 2003/0087694 | A1 | 5/2003 | Storch | |
| 2003/0094756 | A1 * | 5/2003 | Grauzer et al. | 273/149 R |
| 2003/0151194 | A1 * | 8/2003 | Hessing et al. | 273/149 R |
| 2004/0116179 | A1 | 6/2004 | Nicely et al. | |
| 2005/0012270 | A1 * | 1/2005 | Schubert et al. | 273/149 R |
| 2005/0062227 | A1 | 3/2005 | Grauzer et al. | |
| 2005/0093231 | A1 | 5/2005 | Grauzer et al. | |
| 2005/0137005 | A1 | 6/2005 | Soltys et al. | |
| 2005/0242500 | A1 | 11/2005 | Downs, III | |
| 2006/0027970 | A1 | 2/2006 | Kyrychenko | |
| 2006/0279040 | A1 * | 12/2006 | Downs et al. | 273/149 R |
| 2007/0018389 | A1 | 1/2007 | Downs, III | |
| 2007/0216092 | A1 * | 9/2007 | Fleckenstein | 273/149 R |
| 2007/0256111 | A1 | 11/2007 | Medford et al. | |
| 2007/0275762 | A1 | 11/2007 | Aaltone et al. | |
| 2008/0006998 | A1 | 1/2008 | Grauzer et al. | |
| 2008/0037628 | A1 | 2/2008 | Boyce et al. | |
| 2008/0111300 | A1 | 5/2008 | Czyzewski et al. | |
| 2008/0113783 | A1 | 5/2008 | Czyzewski et al. | |
| 2008/0203658 | A1 | 8/2008 | Grauzer et al. | |
| 2008/0224394 | A1 * | 9/2008 | Shigeta | 273/148 R |
| 2009/0039598 | A2 * | 2/2009 | Shigeta | 273/148 R |

FOREIGN PATENT DOCUMENTS

| | | |
|---|---|---|
| GB | 2 395 138 | 5/2004 |
| WO | 9943404 A1 | 9/1999 |
| WO | WO 00/51076 | 8/2000 |

OTHER PUBLICATIONS

Related PCT International Search Report and Written Opinion—International Patent Application Serial No. PCT/US2006/22911, dated Jun. 1, 2007.

(56) References Cited

OTHER PUBLICATIONS

Related Malaysian Patent Application Preliminary Examination, Search and Substantive Examination Reports—Malaysian Patent Application Serial No. PI 20062710, dated May 8, 2009.
Related Malaysian Patent Application Substantive Examination Adverse Report—Malaysian Patent Application Serial No. PI 20062710, dated May 5, 2009.
Related Philippines Patent Application Formality Examination Report—Philippines Patent Application Serial No. 1-2006-000302, dated Oct. 13, 2006.
Related Singapore Patent Application Examination Report—Singapore Patent Application Serial No. SE 2008 01914 A, dated Jun. 25, 2008.
Related European Patent Application Search Report—European Patent Application No. 06772987.1 dated Jul. 19, 2007.
Press Release for Alliance Gaming Corp., Jul. 26, 2004—Alliance Gaming Announces Contract With Galaxy Macau for New MindPlay Baccarat Table Technology, http://biz.yahoo.com/prnews.
Tcsjohnhuxley—Asia Pacific, "The one and only . . . The Champ," http/www.tcsjohnhuley.com.au—pages from website showing Angel Eye product Jan. 27, 2008.
Photographs of TCS John Huxley Angel Eye product, taken Jan. 24, 2008 (8 color photos).
"Safe Jack, the Only and Real Black Jack Control System", dated Sep. 30, 2009.
Scarne, John, "Scarne's New Complete Guide to Gambling," A Fireside Book, 1974, pp. 382-388.
Tracking the Tables, by Jack Bularsky, Casino Journal, May 2004, vol. 17, No. 5, pp. 44-47.

* cited by examiner

ERGONOMIC CARD DELIVERY SHOE

CROSS-REFERENCE TO RELATED APPLICATIONS

This application claims separate and collective priority under 35 U.S.C. §120 as a continuation-in-part application from each of U.S. patent application Ser. No. 11/983,463, filed Nov. 9, 2007, now abandoned, and U.S. patent application Ser. No. 11/417,894, filed May 3, 2006, now U.S. Pat. No. 7,593,544, issued Sep. 22, 2009, the contents of which are incorporated by reference herein in their entireties.

This application is also related to U.S. patent application Ser. No. 11/152,475, filed Jun. 13, 2005, now U.S. Pat. No. 7,769,232, issued Aug. 3, 2010, the content of which is incorporated by reference herein in its entirety. This application is also related to U.S. patent application Ser. No. 10/915,914, filed Aug. 10, 2004, now U.S. Pat. No. 7,264,241, issued Sep. 4, 2007, U.S. patent application Ser. No. 10/880,408, filed Jun. 28, 2004, now abandoned, and U.S. patent application Ser. No. 10/622,321, filed Jul. 17, 2003, now U.S. Pat. No. 7,029,009, issued Apr. 18, 2006.

TECHNICAL FIELD

The present invention relates to apparatus and methods for the delivery of playing cards.

BACKGROUND

Playing cards are ordinarily provided to players in casino table card games either directly from a deck held in a dealer's hands or with cards removed by the dealer from a dealing shoe. The original dealing devices were little more than trays that supported the deck(s) of cards and allowed the dealer to remove the front card (with its back facing the table to hide the rank of the card) and deliver it to a player. Over the years, both stylistic and functional changes have been made to dealing shoes, which have been used for blackjack, poker, baccarat and other casino table card games.

Recently, card recognition technology has been incorporated into card shoes in order to recognize cards as they are dealt for various purposes, including for game play and for security reasons. U.S. patent application Ser. No. 11/417,894 ("the '894 application"), assigned to Shuffle Master, Inc. and published as US 2006/0279040 A1, discloses such technology and a card shoe including such technology, which is incorporated herein by reference.

In the card shoe disclosed in the '894 application, the use of a physical device or component on an interior surface of the card exit port of a shoe has been used to limit the number of cards that can be pulled from the shoe at one time. A declining card support surface and two opposing side walls are used for retaining a group of pre-shuffled cards. The card dealing shoe has an exit end with an opening for the manual removal of individual cards. Located proximate the exit end of the shoe can be a card recognition sensor and an associated card position sensor. A card feed limiter is provided to assure that only a single card exits the shoe at one time, and that the printed material on the card comes into close proximity to, or contact with, the sensors, facilitating the scanning of the card markings.

A fixed card feed limiter, such as that disclosed in the '894 application, could be improved. Its configuration can require an exertion of greater force by a dealer to extract a playing card from the shoe, depending on the thickness of the cards stored therein. Related to this, the fixed card feeder limiter may not be compatible with some playing cards, again, depending on card thickness and size. Furthermore, residue from the playing cards, which may accumulate after even limited use of the cards, can build up on the sensors for the card-reading system. This residue buildup can cause the system to malfunction, e.g., card misreading, and require service. A card dealing shoe that can accommodate varied card thickness and allow easy access to the card-reading sensors for cleaning or repair would be advantageous.

It would also be advantageous to provide a card shoe that permits more freedom of movement of cards as they are removed from the shoe, in a horizontal plane or parallel to the horizontal plane defining the playing surface as cards are being removed from the shoe, or in another plane that is angled with respect to the horizontal plane. This greater freedom of movement advantageously prevents the dealers from experiencing fatigue and repetitive stress injuries resulting from dealing cards repeatedly from a shoe.

BRIEF SUMMARY OF THE INVENTION

An apparatus for handling cards has a card dispensing end. The card dispensing end has a base plate for supporting cards being manually removed from the card dispensing end. At least one upper plate is provided and is spaced apart from the base plate. The at least one upper plate has a substantially U-shaped opening for manual removal of cards positioned between the base plate and the upper plate. A space defined by the distance between the at least one upper plate and the base plate defines a slot. In one embodiment, the plates are parallel and a slot depth is substantially uniform for at least a length of a short side of a card. The slot is large enough for a card to pass through.

First and second spaced apart card guides define side edges of the slot. The first card guide is shorter in length than the second card guide, defining an offset in a first direction of travel of cards being removed. A terminal end of the second card guide extends beyond an end of the first card guide. The card guides are elongated and function to retain cards in an orientation that enables accurate sensing of card suit and rank. In one embodiment, the card guides function to force the short side of the cards to remain substantially perpendicular to a contact image sensor (CIS) line sensor.

A method of delivering a playing card from a playing card handling device is disclosed. The method comprises the step of providing a playing card delivery area defined by an upper plate with a finger slot, a base plate, a first card guide and a second spaced apart card guide. These components define an output slot through which playing cards can be slidably removed. The second card guide extends further in a first direction of travel of cards than the first guide. The method includes additional steps of placing a playing card in the playing card delivery area; a dealer moving a leading edge of the card in a first direction of travel until a trailing edge of the card clears a terminal end of the first card guide; and the dealer moving the card in at least one additional direction of travel before the card completely exists the card dispensing end.

DETAILED DESCRIPTION

Figure 1:
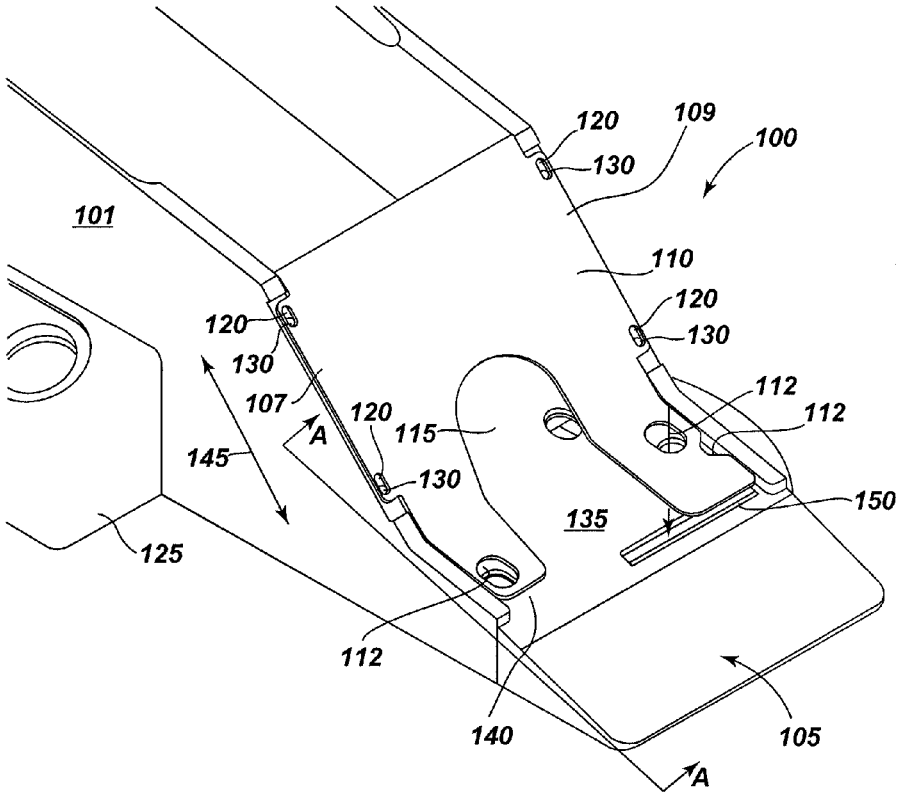
FIG. 1 is a perspective view of a front end of a playing card dealing shoe with a card feed limiter, with a protective cover removed.

In the following detailed description, reference is made to the accompanying drawings, which form a part hereof, and in which is shown by way of illustration, specific embodiments that may be practiced. These embodiments are described in sufficient detail to enable those of ordinary skill in the art to make and use them, and it is to be understood that structural, logical, or procedural changes may be made to the specific embodiments disclosed.

The present invention relates to a card shoe for storing and delivering cards for a card game and to methods of fabricating such a shoe. Although the card shoe can be a component of a card handling device useful for shuffling, card verification, card delivery and/or card storage, in an embodiment described herein, the exemplary shoe stores and functions as a card dispenser. Additionally, the shoe incorporates card-reading systems, a detachable and adjustable card feed limiter and a detachable protective cover. Of note, the card-reading systems of the present invention can be used with any conventional casino-style playing card of any brand. No special adaptation for the cards, such as imprinting with a bar code, is necessary for the reading systems to identify the suit and rank of such cards.

Embodiments of the invention are discussed below with reference to the figures, wherein like reference numbers denote like features. The front end of an exemplary embodiment of playing card dealing shoe 100 is shown in FIGS. 1-4. A view of an entire exemplary playing card dealing shoe 100 is shown in FIG. 5. The card dealing shoe 100 can be fabricated by assembling components as discussed below. The card dealing shoe 100 has a generally rectangular shaped body 101 as shown in FIG. 5, suitable for holding standard playing cards and can be sloped from a rear end 102 to a front end 105 where stored cards are removed. Cards are loaded from above by removing upper cover 103. The card dealing shoe 100 can hold one or multiple card decks, such as a group of eight standard 52-card decks used for many casino games. The body 101 can be constructed of a rigid plastic, metal, wood, or other durable material. FIG. 5 also shows cards 501 loaded into the card dealing shoe 100, ready to be dispensed manually.

Cards can be shuffled prior to insertion into the card dealing shoe 100, or, card dealing shoe 100 can be an integral part of a card shuffler, so that shuffled cards can be automatically delivered into the card dealing shoe 100 by the shuffler. An example of a shuffler with an integral shoe is fully disclosed in U.S. Pat. No. 6,254,096, assigned to Shuffle Master, Inc., the content of which is hereby incorporated by reference. Cards may be manually inserted into the exemplary card dealing shoe 100 and are manually removed by pressing downwardly on an outer surface of a card 501 through an inverted U-shaped opening 115 in the front end 105 of the card dealing shoe 100.

Figure 4:
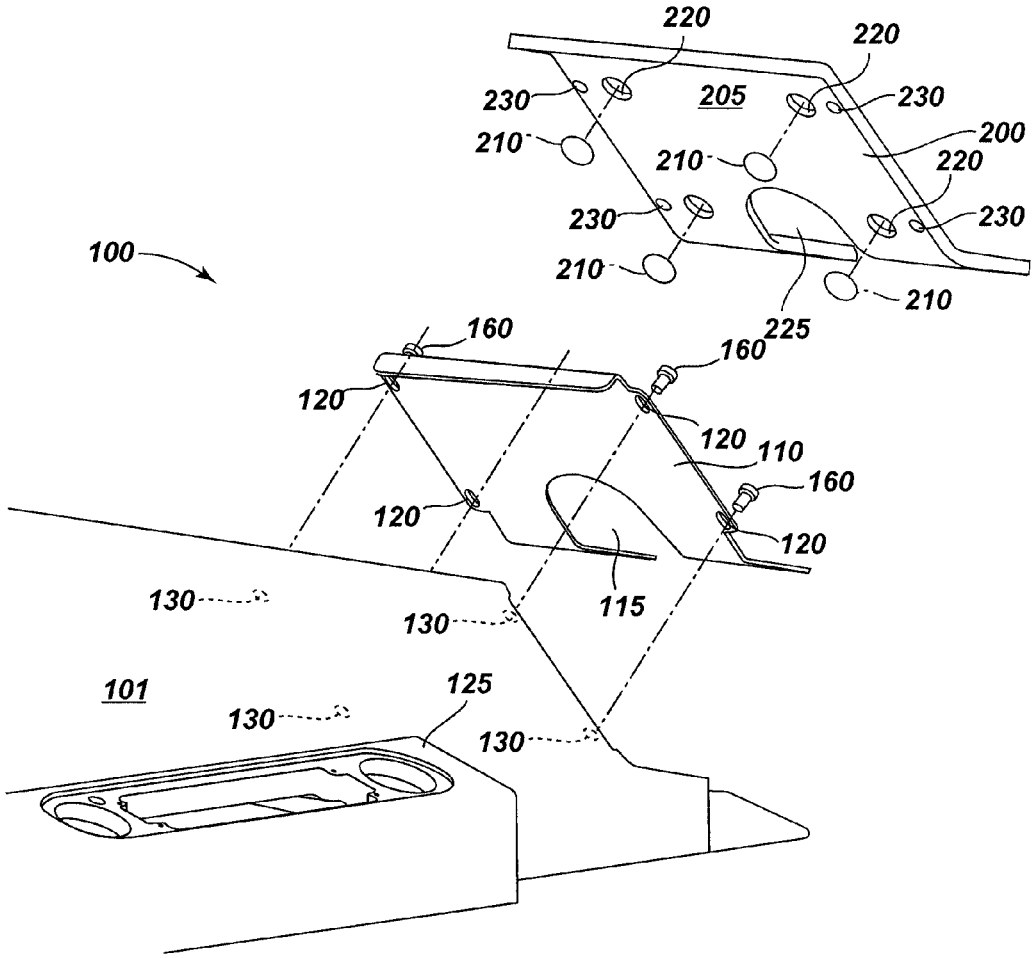
FIG. 4 is an exploded view of an example of a front end of a playing card dealing shoe, exposing a bottom surface of a card feed limiter and a protective cover.
Figure 5:
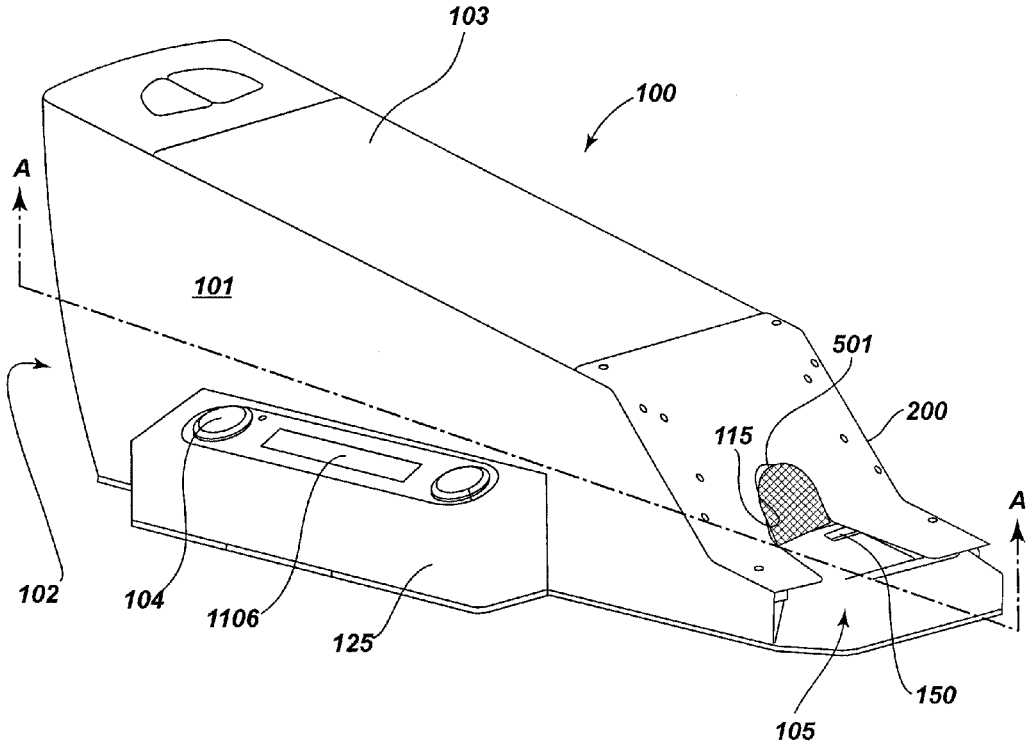
FIG. 5 is a perspective view of a loaded playing card dealing shoe with a card feed limiter, with a protective cover removed.

As shown in FIG. 1 and more clearly in FIGS. 4 and 5, one side of the card dealing shoe 100 can have a control panel 125 that can outwardly protrude from the shoe body 101 and can contain a plurality of buttons 104 and a display 1106. Such a control panel 125 is useful for a dealer who would use the card dealing shoe 100 to deliver cards to a casino card game. In one embodiment of the invention, the control panel 125 display is an LED display and is configured to provide a variety of information to a dealer, such as banker and player hand composition, game outcome, jam detection, cut card presence, the presence of a card from an unauthorized deck, the presence of a card from an unauthorized casino, a marked card, and the like.

The details of a control system contained within a shoe that provides game data and game outcome information to a game of baccarat is disclosed in U.S. application Ser. No. 11/417,894, filed May 3, 2006, now U.S. Pat. No. 7,593,544, issued Sep. 22, 2009.

Figure 2:
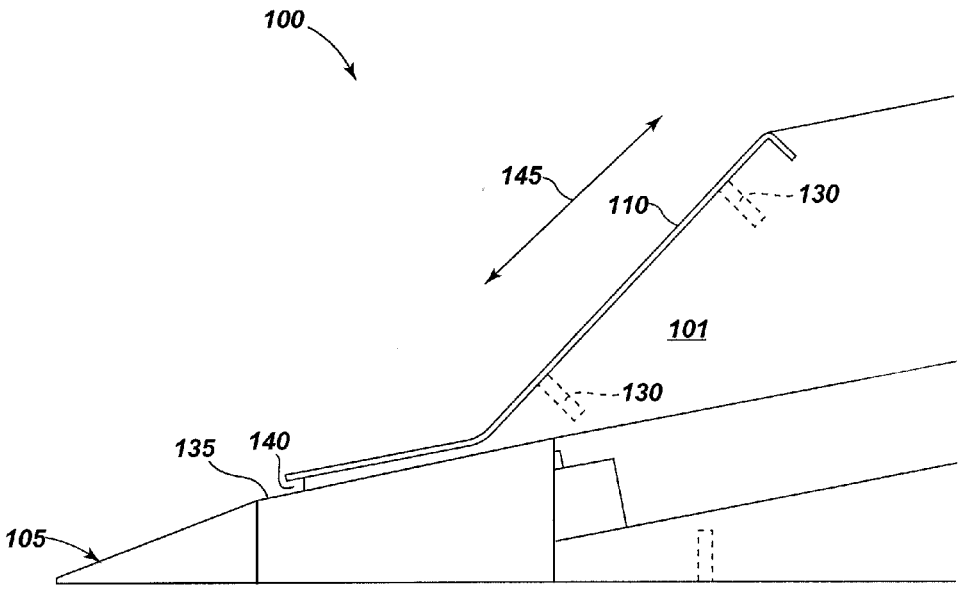
FIG. 2 is a side elevation view of a front end of a playing card dealing shoe with a card feed limiter, with a protective cover removed.

As shown in FIG. 1, the front end 105 of the card dealing shoe 100 comprises a plate-like card feed limiter 110 bearing an inverted U-shaped opening 115. The card feed limiter 110 is preferably made from rigid material like the card dealing shoe 100, such as a rigid plastic or a metallic material, but may be any suitable material. The card feed limiter 110 slopes downwardly at an upper portion and is substantially parallel with a base plate 135 portion of the card dealing shoe 100 at a lower portion of the card feed limiter 110, as shown in FIGS. 1 and 2. The card feed limiter 110 limits a height of a card slot and prevents more than one card from exiting the card dealing shoe 100 at one time, and additionally provides structure to retain cards within the card dealing shoe 100. Furthermore, the card feed limiter 110 functions to bring the cards into close proximity to one or more sensors 150 at the base plate 135 such that the cards can be accurately identified using the sensor(s) 150. A preferred sensor is a CIS (contact image sensor) line sensor, disclosed in the '894 application. A suitable distance range between the sensor 150 and the card face is approximately 0.01 inch to 0.04 inch for this type of sensor.

As shown in FIG. 2, the base plate 135 connects with a sloped front end 105 of the card dealing shoe 100 so that cards can easily slide out of the card dealing shoe 100 onto a card playing surface, such as a gaming table. The card feed limiter 110 is detachably fixed to the body 101 of the card dealing shoe 100 in a single position, but is adjustable in position relative to the base plate 135 along direction line 145. The card feed limiter 110 can be coupled to the card dealing shoe 100 in a manner that allows the height of card feed limiter 110 above base plate 135 to be adjusted relative to the body 101 and base plate 135, or separated entirely from the card dealing shoe 100, and can be repositioned relative to the card dealing shoe 100 and base plate 135 along direction line 145 to change the size of a gap 140, (i.e., a height of the card slot) between the card feed limiter 110 and the base plate 135. The size of the gap 140 can be tailored to the thickness of individual cards held in the card dealing shoe 100, providing the advantage of requiring less force to remove cards, thereby extending the life of the playing cards and card dealing shoe 100, improving the flow of cards onto the table game, and ensuring that cards are accurately identified by the sensor(s) 150 as desired.

Figure 3:
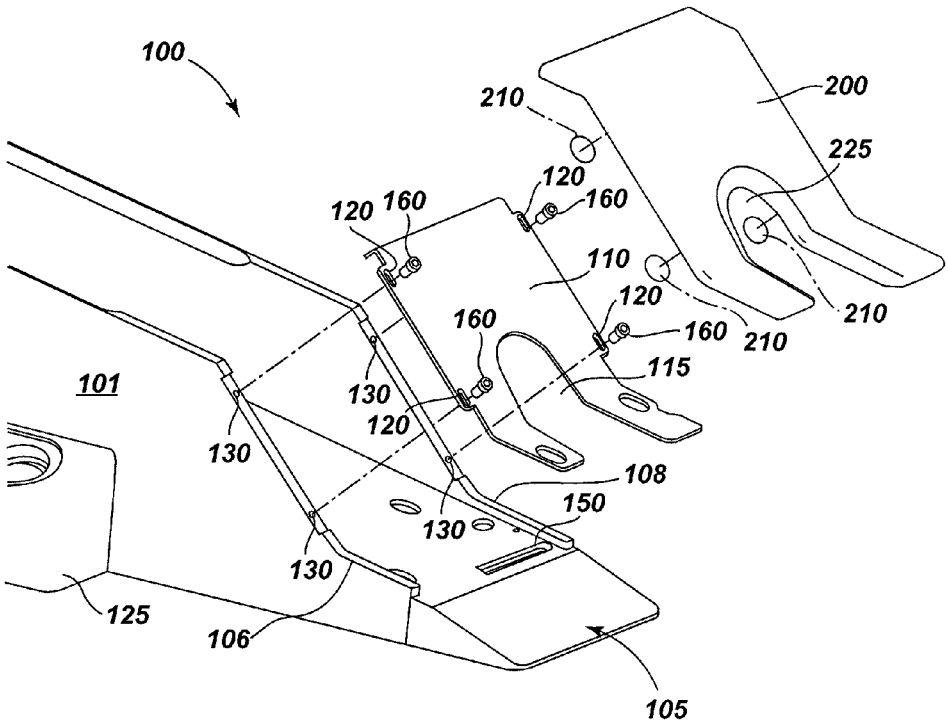
FIG. 3 is an exploded view of an example of a front end of a playing card dealing shoe of the present invention.

In the embodiment of the invention as shown in FIGS. 1-5, the card feed limiter 110 is adjustably and detachably affixed to the card dealing shoe 100 via fasteners 160, which can, for example, connect the card feed limiter 110 to the body 101 of card dealing shoe 100 through elongated slots 120 provided in the card feed limiter 110. The elongated slots 120 of card feed limiter 110 respectively align with a plurality of holes 130 in the front end 105 of card dealing shoe 100. The long axis of elongation of the slots 120 is in a direction along line 145, which allows the card feed limiter 110 to be positioned along this line 145. The fasteners 160 can be screws, as shown in FIG. 3, but can be other fastening devices as well, such as bolts, toggle fasteners, and other devices. Once the card feed limiter 110 is positioned such that gap 140 between the card feed limiter 110 and the base plate 135 accommodates a playing card of a desired thickness, as well as to ensure desired proximity between exiting cards and the sensor(s) 150, fasteners 160 may be secured through slots 120 into holes 130, thereby attaching the card feed limiter 110 to the card dealing shoe 100 for use.

Although the embodiment illustrated in FIGS. 1-5 provides for adjustability of card feed limiter 110 relative to the body 101 of card dealing shoe 100 and fastening of the card feed limiter 110 using elongated slots 120 in the card feed limiter 110 and associated fasteners 160, other structures can also be provided that permit such adjustability and secure fastening. For example, hook-and-loop fasteners 160 or quick connect couplers (not shown) respectively attached to the body 101 and underside of the card feed limiter 110 can be used to allow separation of the two, adjustability of the gap 140 and secure fastening of the card feed limiter 110 to the card dealing shoe 100.

As discussed above, in the embodiment shown in FIGS. 1-5, the card dealing shoe 100 can be equipped with one or more sensors 150. For example, a card-reading line sensor can be positioned within the base plate 135 and can be positioned substantially perpendicular to a direction of travel of a card exiting the card dealing shoe 100. A contact image sensor (CIS) is a preferred card-reading sensor, which can operate in cooperation with one or more optical position sensors. With the removal of the fasteners 160 (see FIG. 3) holding the card feed limiter 110 to the card dealing shoe 100, access to the exposed parts of the sensors 150 is easily achieved. Additionally, the card feed limiter 110 can further comprise one or more apertures 112 (see FIG. 1) positioned over the one or more sensors 150 to allow access for cleaning the surface of the sensors 150 without removal of the card feed limiter 110. This feature provides the advantage of providing maintenance access to the sensors 150 for cleaning without the use of tools or removal from the casino table or floor and without the need of any specialized training.

Furthermore, since a preferred contact image sensor 150 typically functions best when a surface is being scanned, here the playing card, is in contact with the sensor 150, the card feed limiter 110 adjustability ensures that the gap 140 between the card feed limiter 110 and base plate 135 is ideal for such contact or close proximity. The sensors 150 can be those disclosed in the '894 application and the card dealing shoe 100 can be connected to a network via an I/O port or wirelessly, if desired. Information about the game being played and/or cards dealt can be transmitted over such a network.

An embodiment of the card dealing shoe 100 can further comprise a detachable protective cover 200 to cover the card feed limiter 110, as shown in FIGS. 3 and 4. The protective cover 200 can have an inverted U-shaped opening 225, which aligns with and generally conforms in shape and size to the U-shaped opening 115 of the card feed limiter 110. The protective cover 200 rests on card guides 106, 108 which are described in more detail below, and on outer edges 107, 109 of card feed limiter 110. The protective cover 200 provides added protection to the underlying card feed limiter 110, the fasteners 160 attaching the card feed limiter 110 to the card dealing shoe 100, and the sensors 150, which, but for the protective cover 200 would be at least partially exposed. The protective cover 200 provides a barrier to prevent debris from collecting on the sensors 150 aligned with apertures 112. The protective cover 200 is preferably removably attached to the card feed limiter 110 by means of magnets, but any type of attachment means that allows the removal of the protective cover 200 without requiring hand tools is preferred. For example, a number of threaded bolts affixed to the card feed limiter 110 that extend through apertures in protective cover 200 and secured by a threaded wing nut would also suffice.

Figure 6:
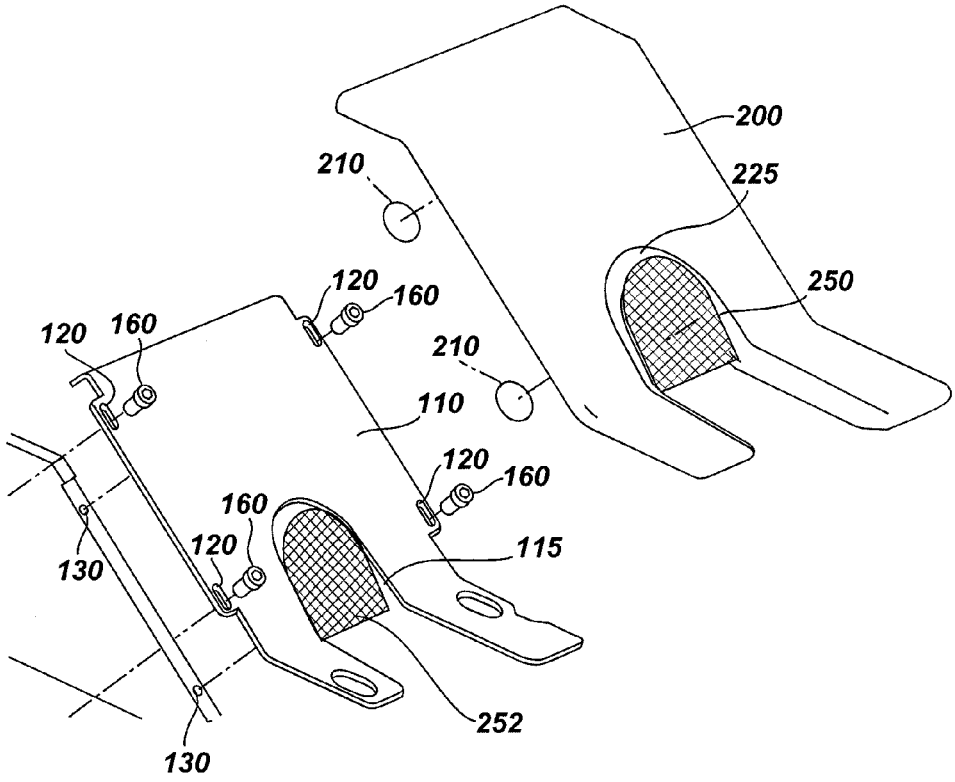
FIG. 6 shows an embodiment of a card feed limiter and protective cover for a card shoe.

If desired, one or both of the card feed limiter 110 and the protective cover 200 can further comprise a shielding device 250 and 252 to hide the underlying card in the card dealing shoe 100, as shown in FIG. 6. This would prevent a game player or the dealer from unfairly recognizing the card value and suit before it is dealt on the occasion that, for example, the card is marked. The shielding device 250, 252 can be brush-like material as shown in FIG. 6, a slidable cover, or other device, which enables the dealer to access and contact the underlying card to be dealt, but hide the card's back surface from view prior to being dealt.

Referring again to FIG. 4, a back surface 205 of protective cover 200 can have a plurality of recesses 230 to receive a top end of fasteners 160, shown as screws, when mounted to adjustable card feed limiter 110, if the top ends of the fasteners 160 are not flush with the card feed limiter 110. The back surface 205 can also have a plurality of larger recesses 220 to accommodate magnets 210 secured therein. When magnets are used, it is preferred that the card feed limiter 110 be constructed of a metal capable of attracting a magnetic force of the magnets. Once the card feed limiter 110 has been adjusted to the desired position and secured to card dealing shoe 100 with fasteners 160, the protective cover 200 can be mounted over the card feed limiter 110. Magnets 210 can secure the protective cover 200 to the card feed limiter 110 if it is metal or has metal or magnetic attachment points so that both inverted U-shaped openings 115, 225 are aligned, allowing the dealer to draw playing cards. Other attachment means for the protective cover 200 can also be used, such as, for example, clips, detachable adhesive, snaps, screws, hook-and-loop fasteners, and other devices suitable to detachably secure protective cover 200 in place.

Figure 7:
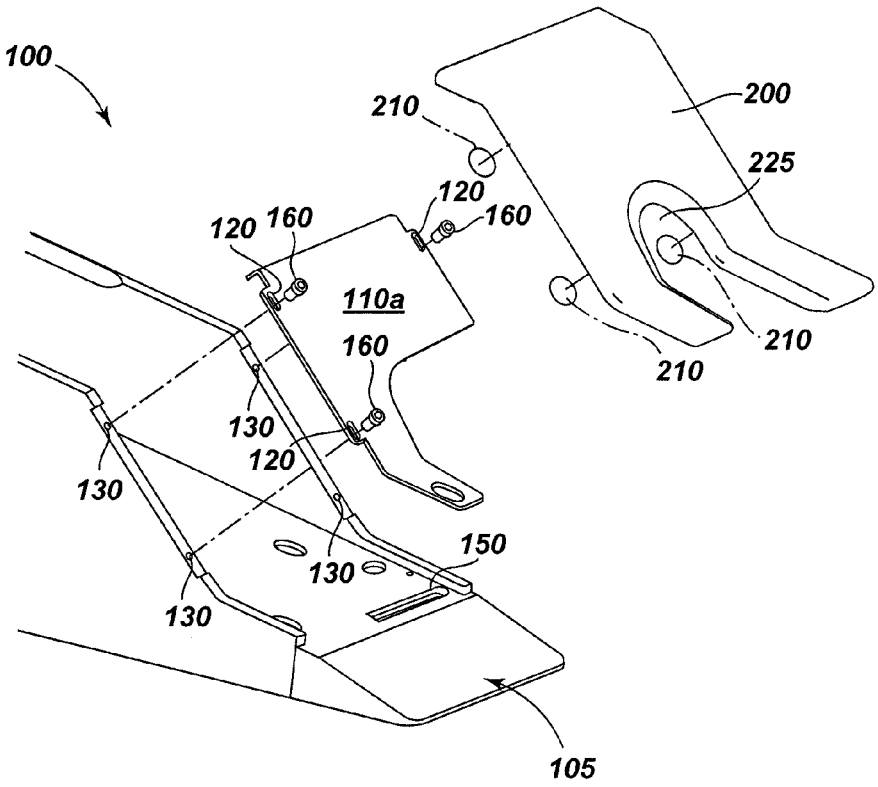
FIG. 7 shows an alternative embodiment of a card feeder limiter and protective cover for a card dealing shoe.

An alternative embodiment is shown in FIG. 7, where a card feed limiter 110*a* is configured so as not to extend over the sensor 150. This provides even greater access to the sensor 150 for cleaning or repair. The protective cover 200 provides shielding for the sensor 150, which protects the sensor from damage and contaminants.

The above-described card dealing shoe 100 having the card feed limiter 110 and protective cover 200 can be used by a casino or dealer during the playing of a card game and may be tailored for cards of various sizes. Because not all cards used in casino games are the same, some are thicker or thinner than others. When an occasion arises for the card dealing shoe 100 to be used with a set of cards of a different thickness, the card dealing shoe 100 may be tailored for such use by changing the gap 140 (FIG. 2) dimension so that such cards are easily removed from the card dealing shoe 100 with an appropriate force.

The method of tailoring the card dealing shoe 100 includes removing the detachable protective cover 200 (preferably by hand and without the use of tools) and exposing the card feed limiter 110 and the fasteners 160, e.g., screws, attaching the card feed limiter 110 to the card dealing shoe 100. Then, the fasteners 160 attaching the card feed limiter 110 to the card dealing shoe 100 are loosened or removed, preferably loosened. Once the fasteners 160 are loosened, the card feed limiter 110 is moved relative to the card dealing shoe 100 along direction line 145, as shown in FIGS. 1 and 2. The card feed limiter 110 is positioned so that the height of the gap 140 is correct for the cards to be used in the card dealing shoe 100. Once the card feed limiter 110 is correctly positioned in this way, the fasteners 160 are tightened, thereby affixing the card feed limiter 110 to the card dealing shoe 100 in a semi-permanent way so that the card dealing shoe 100 can be used for a card playing game. The protective cover 200 is then reattached.

The above-described card dealing shoe 100 having the card feed limiter 110 and protective cover 200 can be used with the card dealing shoe 100 so that the sensors 150 can be easily accessed for repair or cleaning through openings or apertures 112 in the card feed limiter 110. Such access is achieved by first manually removing the protective cover 200. Once the protective cover 200 is removed, sensors 150 can be accessed through the openings 112 in the card feed limiter 110. If greater access to the sensors 150 is required, the fasteners 160 attaching the card feed limiter 110 can be removed and the card feed limiter 110 may be removed from the card dealing shoe 100 so that the sensors 150 can be fully accessed for cleaning or repair.

The present technology also describes an ergonomic arrangement within the apparatus that provides benefits to the dealers and maintains all efficiencies of the card delivery apparatus, whether the arrangement is incorporated into a delivery shoe or a playing card shuffler having a delivery end thereon. For example, that ergonomic technology can be generally described (separately, or in combination with the structure of the devices described herein, or other card delivery devices known in the art) as an apparatus for dispensing playing cards having a dispensing end, the dispensing end comprising the following components:

- A base plate is provided to support cards being manually removed from the dispensing end. This base plate is preferably in a plane that is angled with respect to the horizontal, but may also be co-planar with the horizontal.
- At least one upper support plate is provided and is vertically spaced apart from the base plate to form a card passage or slot. The at least one upper support plate has a U-shaped opening for a dealer to manually remove cards using a finger, such as a thumb or index finger. The U-shaped opening is of a size and shape to facilitate manual removal of the cards.
- The card passage or slot is also defined by a pair of spaced apart card guides. The first card guide is shorter than the second card guide and terminal ends of the card guides define an offset in a first direction of travel of the cards.
- The first direction of travel is preferably along a longitudinal axis A of the device as shown in FIG. 5. The card guides define side edges of the slot.
- Preferably, the first card guide is positioned proximate the dealer such that cards being removed from the shuffler are free to move in more than one direction (in the horizontal plane), once a trailing edge of the card is moved past a terminal end of the first card guide.

When the shorter card guide is positioned proximate a dealer, cards may be pulled in an X direction (along or parallel to axis A as shown in FIG. 5) in a direction Y perpendicular to direction X, or in a direction with an X and Y directional component.

Cards may be moved out of the shuffler in a straight line (the traditional delivery method), in an arcuate path, along an irregularly shaped path, in an "L" shaped path or in any other manner that is desirable to the dealer without exposing the down turned card face.

The dispensing end may be integrally formed with a card shuffler, such as a continuous card shuffler, or a card dispenser or "shoe" that delivers pre-shuffled cards to a casino card game such as blackjack or baccarat, for example.

According to aspects of the invention, the first card guide has a terminal end with a curved inner surface, permitting cards to pass without being hung up or stuck on the card guide. This curvature may be cylindrical or may be of another shape, as long as the inner edge is not sharp.

One structure of the present invention includes a base plate with at least one sensor embedded in the base plate. At least one sensor is capable of reading standard rank and suit markings on standard playing cards.

In some embodiments, a card feed limiter plate is positioned between the upper plate and the base plate. The necessity of the card feed limiter depends upon the type of sensor used to read card rank and suit. When close proximity between the card and the sensor is needed, a card feed limiter plate is desirable.

When alternative sensors are used, it is not always necessary to provide a card feed limiter. For example, when a CMOS (complementary-metal oxide semiconductor) sensing array is used, the distance between a sensor and a card face can be greater than when a CIS line sensor is used, eliminating the need for a card feed limiter.

Figure 8:
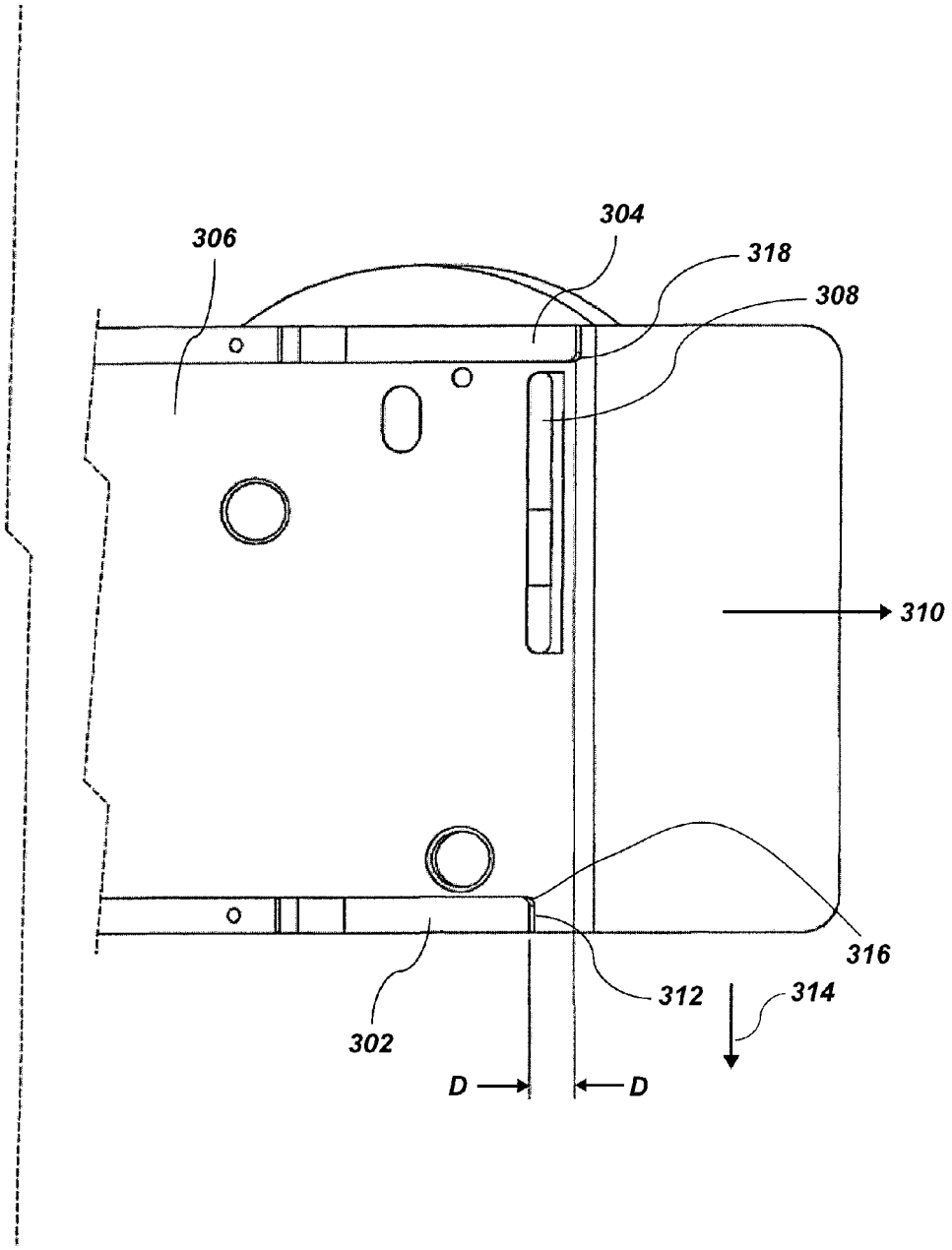
FIG. 8 is a cross-sectional view of a dispensing end of the shoe, taken along line A-A as shown in FIG. 1.

Referring now to FIG. 8, a cross-sectional view of a card slot with offset card guides 302 and 304 is shown. The cross-section is taken along line A-A as shown in FIG. 1. The base plate 306 is exposed in this illustration, showing an embedded CIS line sensor 308.

Cards travel generally in a first direction 310. When a trailing edge of a card (not shown) travels past terminal end 312 of the first card guide 302, the card is free to move in a second direction 314, or combinations of directions 310 and 314 in a wide variety of card path shapes. In one embodiment, an offset D between card guides 302, 304 in the first direction 310 is 0.285 inch. However, this dimension is a function of the card dimensions, and it is well understood that cards of varying dimensions are available for sale to casinos.

An inner edge 316 is preferably curved, as is inner edge 318 of the terminal end of the second card guide 304 to prevent cards from hanging up in the slot as they are being removed manually from the dispensing end.

Preferably, all card contacting surfaces defining the slot are smooth and free of sharp edges or burrs to facilitate rapid manual removal of cards.

A method of delivering playing cards from a playing card handling device is disclosed. The method includes the step of providing a playing card delivery area. The delivery area is defined by an upper plate with a finger slot, a base plate, a first card guide and a second spaced apart card guide. The card guides and plates define an output slot through which playing cards can be slidably removed.

The second card guide extends further in a first direction of travel of the card. The method includes placing a card in the playing card delivery area, and the dealer moving a leading edge of the card in a first direction of travel until a trailing end of the card clears a terminal end of the first card guide. The dealer then may move the card in at least a second direction of travel while removing the card.

The second direction of travel may be in any direction other than the first direction of travel, such as in a direction perpendicular to the first direction, in an arc-shaped path, in an irregularly shaped path, in an L-shaped path, etc. Preferably, the second direction of travel is not parallel to the first direction of travel.

Although the card guide nearest the dealer is illustrated in the drawings as being on the left side of the shoe (looking down the long axis from the exit end), the card guide may be positioned on the opposite side, depending upon the position of the shoe on the table.

The shoe illustrated in the drawings is for the game of baccarat, where dealers position the shoe to the left. In other games, the shoe might be positioned to the dealer's right, making it desirable to position the dealer controls and the first shorter card guide on the opposite side of the machine.

Benefits of the present technology may also be described in more functional terms with respect to elements in the structure of the card delivery end of the devices, whether a delivery shoe or a playing card shuffler has a delivery end thereon. When there is a tight fit between the walls of the device where cards are removed by the dealer, a shallow angle of relative rotation between the front and the back causes drag and erratic card removal, and uneven card-reading capability as cards are withdrawn. The present technology increases the angle at which cards can be rotated as they are being withdrawn from the device, while each playing card maintains a two-point contact (one point on each side edge of the playing card) with the walls of the device. Other possible modifications, such as notching one corner of the barrier plate could create a three-point contact that might even increase unwanted drag. The three points of contact can be envisioned as against the two corners of the notch and the far wall of the output slot. Even if there were not the three-point contact, the card could "stutter" as it moves from one corner on a notch to another corner.

Rotation of a playing card, as discussed herein, relates to rotation of the card about its geometric center and can also be seen as the angle of the long central axis of the playing card with respect to the long axis of the exit slot in the device. Cards may be allowed to rotate between 5° and 40° as they remain in two-point contact with the last 20% of the card retained in the card slot. Preferably, the cards may be allowed to rotate between 10° and 40° or between 15° and 35° as they remain in two-point contact with the last 20% of the card retained in the card slot.

The above description and drawings should be considered illustrative of example embodiments that achieve the features and advantages described herein. Modification and substitutions to specific conditions and structures can be made. Accordingly, the invention is not to be considered as being limited by the foregoing description and drawings, but is only limited by the scope of the appended claims.

The invention claimed is:

1. An apparatus for handling cards, the apparatus comprising:

a base plate for supporting cards being manually removed from the apparatus;

at least one upper plate spaced apart from the base plate, the at least one upper plate having a substantially U-shaped opening for manual removal of cards, wherein a space between the base plate and the at least one upper plate defines a slot for a card to pass through, the slot having a card receiving end and a card delivery end for removing cards from the apparatus under the substantially U-shaped opening; and first and second card guides defining side edges of the slot and spaced apart to enable passage of a card therebetween, wherein the first card guide is shorter in length at the card delivery end of the slot than the second card guide and wherein the first card guide has an inner surface at a terminal edge of the first card guide that is curved.

2. The apparatus of claim 1, wherein the apparatus is a shoe.

3. The apparatus of claim 1, wherein the apparatus is a shuffler.

4. The apparatus of claim 3, wherein the shuffler is a continuous shuffler.

5. The apparatus of claim 1, wherein the first card guide is positioned on a side of the apparatus nearest a dealer position.

6. The apparatus of claim 1, wherein cards are movable in a second direction of travel perpendicular to the to a first direction of travel of intended card removal when a trailing edge of a card is free of the first card guide.

7. The apparatus of claim 1, further comprising a card-reading sensor positioned in the base plate.

8. The apparatus of claim 1, further comprising a card limiter plate between the at least one upper plate and the base plate, the card limiter plate positioned to limit a height of the slot and to prevent more than one card at a time from passing through the slot and the at least one upper plate positioned to cover and to provide a barrier over the card limiter plate.

9. The apparatus of claim 7, wherein the card-reading sensor is configured to identify the suit and rank of cards removed from the apparatus.

10. The apparatus of claim 8, wherein a distance defining a height of the slot between the card limiter plate and base plate is adjustable.

11. The apparatus of claim 8, wherein the upper plate comprises a protective cover that is detachably secured adjacent to the card limiter plate.

12. An apparatus for handling cards, the apparatus comprising:

a base plate for supporting cards being manually removed from the apparatus;

at least one upper plate spaced apart from the base plate, the at least one upper plate having a substantially U-shaped opening for manual removal of cards, wherein a space between the base plate and the at least one upper plate defines a slot for a card to pass through, the slot having a card receiving end and a card delivery end for removing cards from the apparatus under the substantially U-shaped opening; and first and second card guides defining side edges of the slot and spaced apart to enable passage of a card therebetween, wherein the at least one upper plate comprises a first side and a second, opposite side defining the substantially U-shaped opening, the first side of the at least one upper plate configured to be positioned over the first card guide, the first side of the at least one upper plate being shorter in length than the second side of the at least one upper plate, wherein the first card guide is shorter in length at the card delivery end of the slot than the second card guide and wherein the first card guide has a curved inner surface at a terminal edge of the first card guide such that the inner surface of the terminal edge is not sharp.

13. An apparatus for handling cards, the apparatus comprising:

a base plate for supporting cards being manually removed from the apparatus;

at least one upper plate spaced apart from the base plate, the at least one upper plate having a substantially U-shaped opening for manual removal of cards, wherein a space between the base plate and the at least one upper plate defines a slot for a card to pass through, the slot having a card receiving end and a card delivery end for removing cards from the apparatus under the substantially U-shaped opening; and first and second card guides defining side edges of the slot and spaced apart to enable passage of a card therebetween, wherein the first and second card guides are positioned to limit rotation of a card having about 20% of the card retained in the slot to between about 5° and about 40° from an axis along a first direction of travel of intended card removal when the card is in contact with each of the first and second card guides, wherein the first card guide is shorter in length at the card delivery end of the slot than the second card guide and wherein the first card guide has a curved inner surface at a terminal edge of the first card guide.

14. The apparatus of claim 13, wherein the first and second card guides are positioned to limit rotation of the card to between about 15° and about 35°.

* * * * *

UNITED STATES PATENT AND TRADEMARK OFFICE

CERTIFICATE OF CORRECTION

PATENT NO. : 8,636,285 B2
APPLICATION NO. : 12/501322
DATED : January 28, 2014
INVENTOR(S) : Attila Grauzer, Paul K. Scheper and Sion D. Walsh It is certified that error appears in the above-identified patent and that said Letters Patent is hereby corrected as shown below:

In the claims:

CLAIM 6, COLUMN 10, LINE 14, change "to the to a first" to --to a first--

Signed and Sealed this
First Day of September, 2015

Michelle K. Lee

Michelle K. Lee
*Director of the United States Patent and Trademark Office*